United States Patent [19]

Kiyota et al.

[11] Patent Number: 4,646,691

[45] Date of Patent: Mar. 3, 1987

[54] AUXILIARY FUEL SUPPLY DEVICE FOR ALCOHOL ENGINE

[75] Inventors: Yuuhiko Kiyota, Nagaokakyo; Tooru Okada, Kameoka; Jun Isomoto, Kyoto, all of Japan

[73] Assignee: Mitsubishi Jidosha Kogyo Kabushiki Kaisha, Tokyo, Japan

[21] Appl. No.: 762,960

[22] Filed: Aug. 6, 1985

[30] Foreign Application Priority Data

Aug. 10, 1984 [JP] Japan ..... 59-123547[U]

[51] Int. Cl.[4] ..... F02M 1/16

[52] U.S. Cl. ..... 123/179 G; 123/1 A; 123/180 R; 123/180 AC; 123/576

[58] Field of Search ..... 123/179 G, 180 AC, 180 R, 123/576, 578, 1 A

[56] References Cited

U.S. PATENT DOCUMENTS

| | | | |
|---|---|---|---|
| 4,144,861 | 3/1979 | Yamashita et al. | 123/179 G |
| 4,205,641 | 6/1980 | Yamasaki et al. | 123/179 G |
| 4,380,974 | 4/1983 | Grosso | 123/179 G |
| 4,401,094 | 8/1983 | Shimmura | 123/179 G |
| 4,441,467 | 4/1984 | Powell | 123/179 G |

*Primary Examiner*—E. Rollins Cross

*Attorney, Agent, or Firm*—Robert E. Burns; Emmanuel J. Lobato; Bruce L. Adams

[57] ABSTRACT

In an alcohol engine using a alcohol and foreign fuel having combustibility higher than that of the alcohol as a fuel, an auxiliary fuel quantity adjusting means and control means are provided so that a ratio of a quantity of the foreign fuel to a quantity of the alcohol in the fuel to be supplied to the engine upon cold starting of the engine may be different from that upon warm-up of the engine.

5 Claims, 4 Drawing Figures

AUXILIARY FUEL SUPPLY DEVICE FOR ALCOHOL ENGINE

BACKGROUND OF THE INVENTION

This invention relates to an auxiliary fuel supply device for an engine using alcohol as a main fuel.

Generally, in an alcohol engine using 100% alcohol such as methanol or ethanol as a fuel, or using alcohol which does not contain additives containing a low boiling point component, a cold start operation and a warm-up operation of the engine are greatly difficult owing to less inflammable characteristics of alcohol as compared with gasoline.

Namely, alcohol has a latent heat of vaporization greater than that of gasoline and a high inflammation point, and is composed of a single component exclusive of the low boiling point component. Therefore, there occurs difficulty in cold starting operation and warm-up operation in the alcohol engine.

To solve this problem, there has been proposed a device for supplying a small quantity of gasoline to an upstream side of a venturi portion of a carburetor. However, atomization of gasoline as the foreign fuel may not be sufficiently conducted. Further, a quantity of the gasoline to be supplied is smaller than that of the alcohol, resulting in unsufficient effect of fuel atomization.

To improve atomization, there has been proposed a device for supplying gasoline to a main well of the carburetor in a single system covering the cold starting operation and the warm-up operation of the engine. However, such a device may not cope with the fact that a quantity of an auxiliary fuel to be required upon cold starting is different from that upon warm-up. If the quantity of the auxiliary fuel to be required upon cold starting is set, the quantity of the auxiliary fuel to be supplied upon warm-up becomes uneconomically excessive.

SUMMARY OF THE INVENTION

Accordingly, it is an object of the present invention to provide an auxiliary fuel supply device for an alcohol engine for supplying an auxiliary fuel of different quantities according to a cold start condition and a warm-up condition of the alcohol engine, that is, upon cold starting of the engine, a foreign fuel having combustibility higher than that of alcohol is mixed with the alcohol and the mixed fuel is supplied to a fuel supply system, thereby making the engine start easy. On the other hand, upon warm-up of the engine, the alcohol and the foreign fuel are mixed with each other in a predetermined ratio even after starting of the engine, thereby facilitating warm-up of the engine.

According to the present invention, the auxiliary fuel supply device for the alcohol engine comprises a main fuel tank storing alcohol, an auxiliary fuel tank storing a foreign fuel having combustibility higher than that of the alcohol, a fuel supply system connected to the main fuel tank for supplying the alcohol in the main fuel tank to the engine, an auxiliary fuel passage for connecting a fuel supply passage of the fuel supply system to the auxiliary fuel tank, an auxiliary fuel quantity adjusting means for adjusting a flow of an auxiliary fuel in the auxiliary fuel passage, and a control means for operating the auxiliary fuel quantity adjusting means so that a ratio of a quantity of foreign fuel to a quantity of the alcohol in a fuel to be supplied to the engine upon cold starting of the engine may be different from that upon warm-up of the engine.

With this arrangement, a ratio of a quantity of the foreign fuel to a quantity of the alcohol in the fuel to be supplied to the engine may be controlled to be different from each other upon cold starting and warm-up of the engine The auxiliary fuel supply device of the present invention may exhibit the following effects and advantages with a simple structure.

(1) Upon cold starting of the alcohol engine, a mixed fuel of alcohol and foreign fuel having combustibility higher than the alcohol as mixed in a predetermined ratio is supplied from the fuel supply system to the engine, thereby making engine start easy. On the other hand, upon warm-up of the engine, the mixed fuel of the alcohol and the foreign fuel as mixed in a ratio different from the mixture ratio upon cold starting of the engine is supplied from the fuel supply system to the engine, thereby preventing excessive supply of the foreign fuel and economically facilitating warm-up of the engine (2) As a sum of the quantity of the alcohol and that of the foreign fuel to be supplied from the fuel supply system to the engine is constant, the quantity of the alcohol corresponding to that of the foreign fuel to be mixed is decreased, and the quantity of the foreign fuel to be mixed is increased, while the quantity of the alcohol to be atomized is decreased.

(3) In case of using gasoline as the foreign fuel, the gasoline is atomized well at all times, and accordingly a device for atomizing the gasoline is not required.

(4) Drivability upon warm-up of the engine is improved, and wear corrosion and formation of deposit may be prevented.

DETAILED DESCRIPTION OF THE PREFERRED EMBODIMENTS

Figure 1:
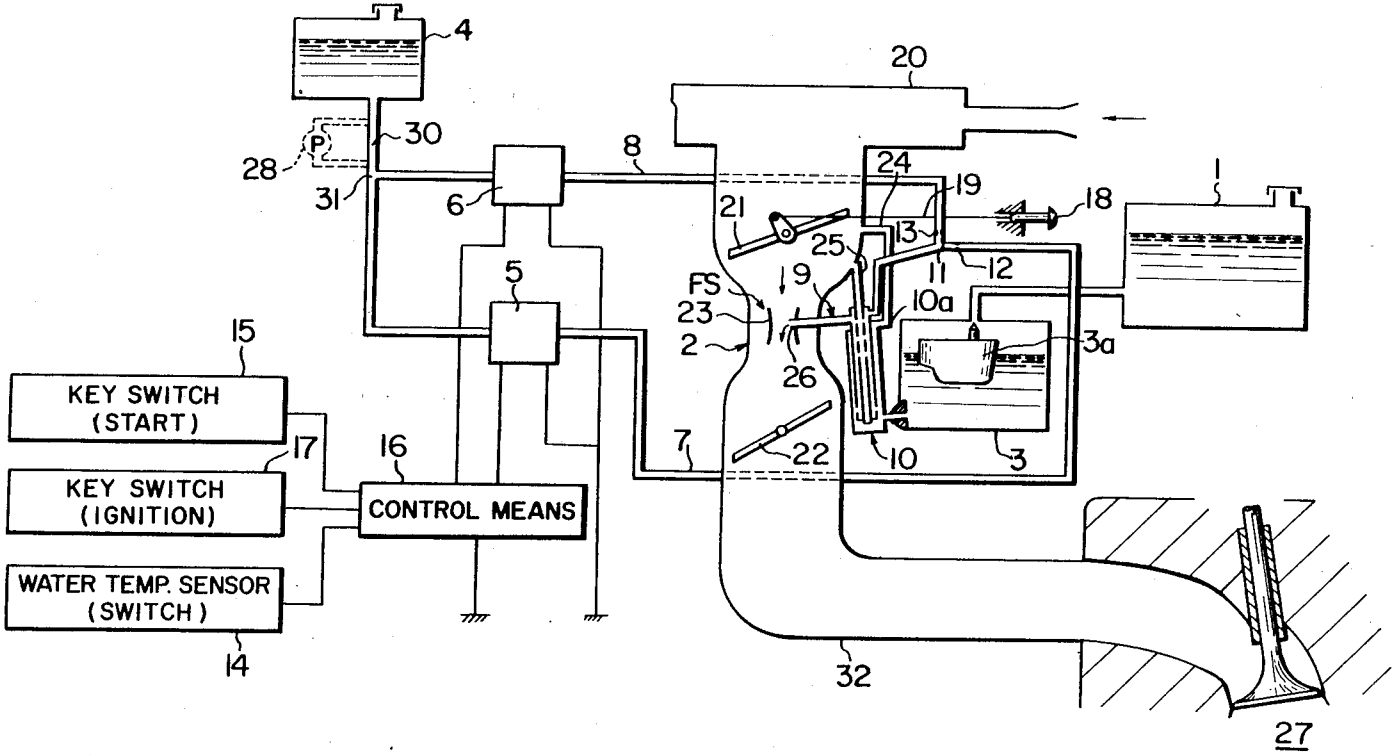
FIG. 1 is a schematic view of the auxiliary fuel supply device for the alcohol engine in a first preferred embodiment of the present invention.

Referring to FIG. 1 which shows a preferred embodiment of the present invention, there is provided a main fuel tank 1 storing alcohol. The main fuel tank 1 is designed to supply alcohol as a main fuel to a float chamber 3 of a carburetor 2 as a fuel supply system FS, a quantity of the alcohol to be supplied being adjusted by a float 3*a*.

There is also provided an auxiliary fuel tank 4 storing gasoline as a foreign fuel. The auxiliary fuel tank 4 is designed to supply gasoline through a first auxiliary passage 7 including a first electromagnetic valve 5 as a valve device and a second auxiliary passage 8 including a second electromagnetic valve 6 as a valve device to an upper portion 10*a* of a main well 10 as a part of a fuel supply passage 9 of the carburetor 2.

Further, there is provided a collective passage 30 for collecting the first and second auxiliary passages 7 and 8 and connecting the same to the auxiliary fuel tank 4 between the first and second auxiliary passages 7 and 8 and the auxiliary fuel tank 4.

These passages 7, 8 and 30 constitute an auxiliary fuel passage. Therefore, the auxiliary fuel passage forms dual lines. The first and second electromagnetic valves 5 and 6 serve as means for adjusting a quantity of auxiliary fuel to be supplied The first auxiliary passage 7 is combined with the second auxiliary passage 8 at a juncture portion 11 provided in the vicinity of the upper portion 10*a* of the main well 10. A large diameter orifice 12 is provided in the first auxiliary passage 7 on an upstream side of the juncture portion 11, while a small diameter orifice 13 is provided in the second auxiliary passage 8 on an upstream side of the juncture portion 11. That is to say, a fuel flow in the first auxiliary passage 7 is set to be larger than a fuel flow in the second auxiliary passage 8.

The first and second electromagnetic valves 5 and 6 are normally closed, and when a temperature detection signal of an engine coolant from a water temperature sensor 14 or a lubrication oil is not greater than a predetermined temperature (e.g., 60° C.), and simultaneously an engine operation detection signal is generated from a key switch start position sensor 15, the valves 5 and 6 are opened by a control signal from a control means (control circuit) 16 in response to an engine starting operation.

The second electromagnetic valve 6 is normally closed, and when the temperature detection signal of the engine coolant from the water temperature sensor 14 or the lubrication oil is not greater than the predetermined temperature (e.g., 60° C.), and simultaneously an engine operation detection signal is generated from a key switch ignition position sensor 17, the valve 6 is opened by a control signal of the control means 16 in response to an engine warm-up operation (cold condition). At this time, the first electromagnetic valve 5 is in a closed condition.

The key switch start position sensor 15 and the key switch ignition position sensor 17 serve as a key switch for detecting positions of an ignition key.

Further, the engine may be provided with a knock sensor. In this case, when an engine knocking condition is detected by the knock sensor, the first and second electromagnetic valves 5 and 6 are supplied with an opening control signal.

The main well 10 receives alcohol from the float chamber 3, and also receives gasoline from the auxiliary fuel tank 4 through the first auxiliary passage 7 with the electromagnetic valve 5 and the second auxiliary passage 8 with the electromagnetic valve 6, thereby adjusting a quantity G of gasoline to a quantity A of alcohol at a value near a proper mixture ratio (e.g., $G:A \approx 1:9$). Such adjustment of the mixture ratio is effected mainly by the orifices 12 and 13 of the first and second auxiliary passages 7 and 8.

The mixed fuel as mentioned above is supplied through the main well 10 of the fuel supply passage 9 to a nozzle 26 of a venturi portion 23 in a suction passage 32.

A throttle valve 22 is provided in the suction passage 32 on a downstream side of the venturi portion 23, and a quantity of the mixed fuel to be supplied to a combustion chamber 27 is adjusted by the throttle valve 22.

Further, a fuel pump 28 may be provided in the collective passage 30 between the auxiliary fuel tank 4 and a juncture portion 31 of the first and second auxiliary passages 7 and 8.

The device shown in FIG. 1 includes a choke button 18, choke wire 19, air filter 20, choke valve 21 and passage 24 and 25.

With this arrangement of the auxiliary fuel supply device for the alcohol engine in the first preferred embodiment of the present invention, the first and second electromagnetic valves 5 and 6 are opened upon cold starting of the engine, and the gasoline passing through the orifices 12 and 13 is fed to the main well 10 of the carburetor 2 thereby to be mixed so that a quantity $G_1$ of the gasoline to the quantity A of the alcohol may be in a predetermined ratio $X (=G_1/A)$.

The mixed fuel is fed to the venturi portion 23 of the carburetor 2, where the gasoline is suitably atomized to make a starting operation of the engine easy.

Then, when such an engine cranking condition is terminated, and the engine is transferred to the warm-up condition, the first electromagnetic valve 5 is closed, and the second electromagnetic valve 6 is opened. Under the condition, the gasoline passing through the orifice 13 is fed to the main well 10 of the carburetor 2, where the gasoline is mixed with the alcohol so that a quantity $G_2 (<G_1)$ of the gasoline to the quantity A of the alcohol may be in a predetermined ratio $Y[=(G_2/A)<X]$.

The mixed fuel is fed to the venturi portion 23 of the carburetor 2, where the gasoline is suitably atomized, and the engine warm-up operation is carried out.

Thereafter, when the engine warm-up operation is facilitated, and the temperature detection signal from the water temperature sensor 14 becomes greater than the predetermined temperature (60° C.), the second electromagnetic valve 6 is closed. Accordingly, no gasoline is supplied to the main well 10 of the carburetor 2, and resultantly the quantity of the alcohol to be supplied is increased by such decrement of the gasoline, thus effecting proper atomization of the fuel at the venturi portion 23.

The first and second electromagnetic valves 5 and 6 may be selectively opened and closed upon cold starting and warm-up of the engine.

In the event that the engine is stopped because of any factors after starting, the control means 16 is operated to close the first and second electromagnetic valves 5 and 6 thereby to stop supply of the gasoline fuel to the main well 10.

As a result, there is no possibility that a fuel containing gasoline in an over-rich proportion is supplied, thereby improving a restarting performance of the engine.

In the case that an engine temperature is greater than a predetermined value, the first and second electromagnetic valves 5 and 6 are maintained in a closed condition during the engine cranking or after the engine starting, and no gasoline fuel is supplied to the fuel supply passage 9. However, since the engine may be operated sufficiently by the alcohol fuel only in this case, there occurs no inconvenience.

Further, upon knocking of the engine, the first and second electromagnetic valves 5 and 6 are opened by the knocking detection signal from the knock sensor, and in a manner similar to the engine cold starting or warm-up condition, the gasoline is fed to the main well 10 of the carburetor 2. Then, a mixed fuel of alcohol and gasoline is fed to the engine, thereby preventing the knocking of the engine.

Figure 2:
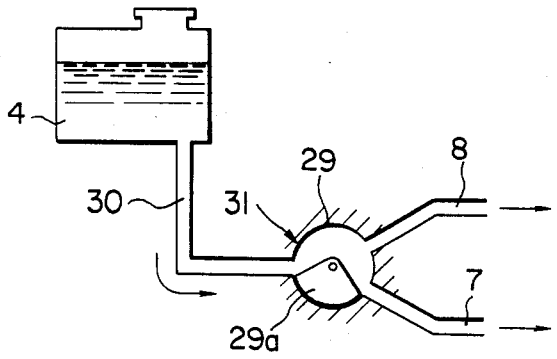
FIG. 2 is a schematic view of an essential part of the auxiliary fuel supply device for the alcohol engine in a second preferred embodiment.
Figure 3:
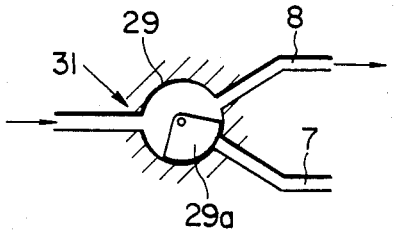
FIGS. 3 and 4 are schematic views showing operation of the second preferred embodiment.
Figure 4:
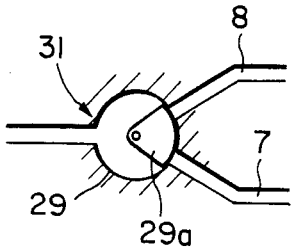

Referring to FIGS. 2 to 4 which shows a second embodiment of the present invention, there is provided a rotary valve 29 as a valve device at the juncture portion 31 of the collective passage 30 and the first and second auxiliary passages 7 and 8. The rotary valve 29 includes a valve body 29*a* directly driven by a step motor (not shown) receiving a control signal from the control means 16.

As to the other constitution, the second embodiment is similar to the first embodiment shown in FIG. 1 except that the first and second electromagnetic valves 5 and 6 are not provided.

The valve body 29*a* is suitably rotated to an engine cold start condition where a large quantity of gasoline is supplied to the main well 10 as shown in FIG. 2, an engine warm-up condition where a small quantity of gasoline is supplied to the main well 10 as shown in FIG. 3, or an engine hot condition where no gasoline is supplied to the main well 10 as shown in FIG. 4. Accordingly, a ratio of the quantity of gasoline to the quantity of alcohol in the fuel to be supplied from the main well 10 through the venturi portion 23 of the carburetor 2 to the suction passage 32 may be suitably controlled in the same manner as the first embodiment.

The rotational condition of the valve body 29*a* is controlled by the control means 16 which has received detection signals of a key switch position and engine coolant temperature, etc.

The valve body 29*a* may be driven by a solenoid through a link mechanism.

The second embodiment exhibits an effect substantially same as that in the first embodiment.

Examples of the foreign fuel may include a liquid fuel such as light naphtha, diethyl ether, N-pentane and iso-pentane.

Further, a gas fuel such as propane and LPG may be used as the foreign fuel. In this case, a gas fuel supply source is connected to the passage 25 on the suction passage 32 side, for example, thereby mixing the gas fuel with alcohol and supplying the gas mixed alcohol to the venturi portion 23 of the carburetor 2.

The fuel supply system FS may be of an injector (injection valve) type. In this case, the first and second auxiliary passages 7 and 8 are connected to the fuel supply passage 9 on an upstream side of a fuel pressure regulator so that the foreign fuel may be supplied to the passage 9, for example, thereby mixing the foreign fuel with alcohol and then supply the mixed fuel from the injector to the suction passage.

What is claimed is:

1. Fuel supply system for an alcohol engine comprising:

a main fuel storage tank for alcohol, an auxiliary fuel storing tank for an auxiliary fuel having a combustibility higher than that of alcohol, a carburetor having a float chamber, a main well communicating with said float chamber and a passage leading from said main well to a fuel nozzle provided in an intake passage of the engine, main valve controlled fuel passage means for supplying alcohol from said main fuel storing tank to said float chamber of said carburetor, auxiliary valve controlled metered fuel passage means for supplying auxiliary fuel to said main well of said carburetor where it is mixed with alcohol, and means for controlling said auxiliary fuel passage means, said control means comprising means for sensing the temperature of the engine, means for sensing the position of an engine ignition switch, and means for sensing the position of an engine start switch, and for controlling said auxiliary fuel passage means to supply a predetermined flow of auxiliary fuel to said main well of said carburetor in a first condition when said ignition switch and start switch are both "on", to supply a lesser predetermined flow of auxiliary fuel to said main well of said carburetor in a second condition when said start switch is "off", said ignition switch is "on" and the temperature of the engine is below a predetermined value, and to supply no auxiliary fuel to said main well of said carburetor in a third condition when said start switch is "off", said ignition switch is "on" and the temperature of said engine is above said predetermined valve.

2. Fuel supply system according to claim 1, in which said auxiliary fuel passage means comprises a valve controlled first metered auxiliary fuel passage and a second valve controlled metered auxiliary fuel passage in parallel with said first auxiliary fuel passage and in which said control means comprising means for opening both of said auxiliary fuel passages when the engine is in said first condition, opening one only of said auxiliary fuel passages when the engine is in said second condition and closing both of said auxiliary fuel passages when the engine is in said third condition.

3. Fuel supply system according to claim 2, in which the valve control of each of said auxiliary fuel passages comprises an electromagnetic cut-off valve in the respective auxiliary fuel passage controlled by said control means.

4. Fuel supply system according to claim 1 in which said auxiliary fuel passage means comprises a branched auxiliary fuel line with a rotary valve controlling flow from a common passage portion into said branches, said rotary valve having three positions namely a first position in which both of said branches are open, a second position in which one only of said branches is open and a third position in which both of said branches are closed.

5. Fuel supply system according to claim 1, in which said carburetor further comprises an air bleed passage means extending from said intake passage to the bottom of said main well for bleeding air into the bottom of said main well to promote mixing of said alcohol and auxiliary fuel in said main well before delivery to said intake passage.

* * * * *